US009255237B2

(12) United States Patent
Tatsumi et al.

(10) Patent No.: US 9,255,237 B2
(45) Date of Patent: Feb. 9, 2016

(54) LUBRICATING OIL ADDITIVE COMPOSITION AND METHOD FOR IMPROVING STORAGE STABILITY OF LUBRICATING OIL ADDITIVE COMPOSITION

(75) Inventors: Yukio Tatsumi, Tokyo (JP); Yukiya Moriizumi, Tokyo (JP); Shinji Iino, Tokyo (JP)

(73) Assignee: ADEKA CORPORATION, Tokyo (JP)

( * ) Notice: Subject to any disclaimer, the term of this patent is extended or adjusted under 35 U.S.C. 154(b) by 184 days.

(21) Appl. No.: 14/113,659

(22) PCT Filed: Apr. 24, 2012

(86) PCT No.: PCT/JP2012/060954

§ 371 (c)(1),
(2), (4) Date: Oct. 24, 2013

(87) PCT Pub. No.: WO2012/147732

PCT Pub. Date: Nov. 1, 2012

(65) Prior Publication Data

US 2014/0045738 A1 Feb. 13, 2014

(30) Foreign Application Priority Data

Apr. 25, 2011 (JP) ..... 2011-096762

(51) Int. Cl.
*C10M 135/24* (2006.01)
*C10M 135/26* (2006.01)
*C10M 135/06* (2006.01)

(52) U.S. Cl.
CPC ..... *C10M 135/06* (2013.01); *C10M 135/26* (2013.01); *C10M 2219/085* (2013.01);
(Continued)

(58) Field of Classification Search
CPC ..... C10M 2219/085; C10M 2219/084
USPC ..... 508/444, 496, 497
See application file for complete search history.

(56) References Cited

U.S. PATENT DOCUMENTS 2,649,416 A 8/1953 Richter et al.
4,800,031 A * 1/1989 DiBiase et al. ..... 508/497

(Continued)

FOREIGN PATENT DOCUMENTS

EP 2 392 637 12/2011
JP 59-116472 7/1984

(Continued)

OTHER PUBLICATIONS

International Search Report issued Jul. 24, 2012 in International Application No. PCT/JP2012/060954.

*Primary Examiner* — Ellen McAvoy
(74) *Attorney, Agent, or Firm* — Wenderoth, Lind & Ponack, L.L.P.

(57) ABSTRACT

The purpose of the present invention is to provide a thiodicarboxylic acid ester which has high long-term storage stability without inhibiting antioxidant properties and wear-resistant properties of the thiodicarboxylic acid ester.
In order to achieve the above-mentioned purpose, the present invention provides a lubricating oil additive composition which is characterized by containing a compound (A) represented by general formula (1) and a compound (B) represented by general formula (2) and by having an acid value of 0.01-0.4 mgKOH/g.

(1)

(in the formula, $R^1$ and $R^4$ each independently represent a hydrocarbon group having 6 to 18 carbon atoms and $R^2$ and $R^3$ each independently represent an alkylene group having 1 to 4 carbon atoms)

(2)

(in the formula, $R^5$ represents a hydrocarbon group having 6 to 18 carbon atoms and $R^6$ and $R^7$ each independently represent an alkylene group having 1 to 4 carbon atoms).

5 Claims, 2 Drawing Sheets

(52) U.S. Cl.
CPC ..... *C10N2230/06* (2013.01); *C10N 2230/10* (2013.01); *C10N 2230/70* (2013.01); *C10N 2240/02* (2013.01); *C10N 2240/04* (2013.01); *C10N 2240/046* (2013.01); *C10N 2240/08* (2013.01); *C10N 2240/10* (2013.01); *C10N 2240/12* (2013.01); *C10N 2240/14* (2013.01); *C10N 2240/40* (2013.01); *C10N 2250/10* (2013.01)

(56) References Cited

U.S. PATENT DOCUMENTS

| | | | | |
|---|---|---|---|---|
| 4,820,430 | A * | 4/1989 | Farng et al. | 508/486 |
| 5,714,441 | A * | 2/1998 | Berlowitz | 508/258 |
| 5,856,280 | A | 1/1999 | Kim et al. | |
| 7,494,960 | B2 * | 2/2009 | Migdal et al. | 508/465 |
| 8,309,499 | B2 * | 11/2012 | Kamano | 508/569 |
| 8,455,413 | B2 * | 6/2013 | Hiyoshi et al. | 508/476 |
| 8,592,356 | B2 * | 11/2013 | Ito | 508/465 |
| 2010/0009882 | A1 * | 1/2010 | Ito | 508/465 |
| 2012/0208731 | A1 * | 8/2012 | Lann et al. | 508/187 |

FOREIGN PATENT DOCUMENTS

| | | |
|---|---|---|
| JP | 7-62368 | 3/1995 |
| JP | 2001-504142 | 3/2001 |
| JP | 2002-294267 | 10/2002 |
| JP | 2008-95076 | 4/2008 |
| JP | 2009-519930 | 5/2009 |
| JP | 2010-121098 | 6/2010 |
| JP | 2010-265397 | 11/2010 |
| WO | 2010/087398 | 8/2010 |
| WO | 2010/131739 | 11/2010 |

* cited by examiner

Fig. 1: Results of wear testing
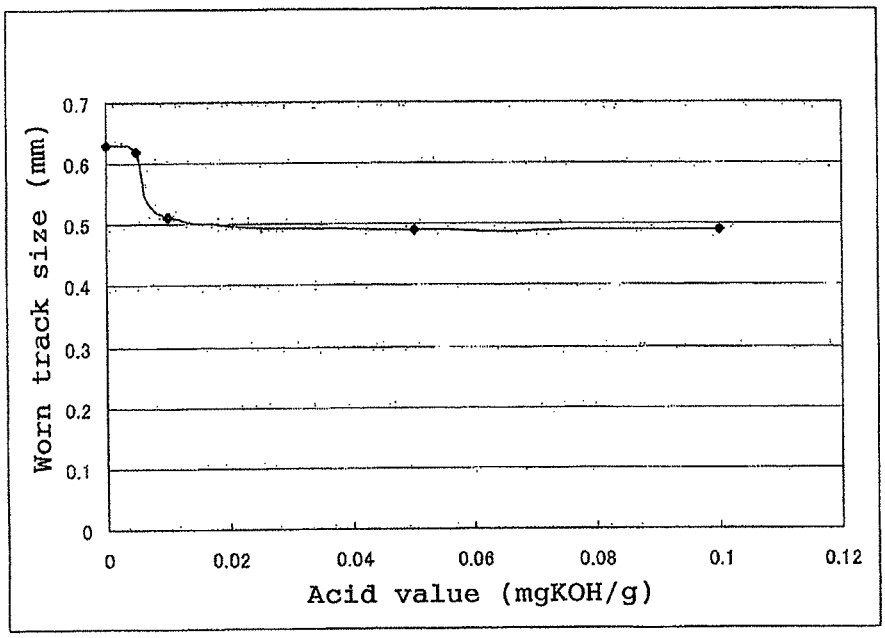

Fig. 2: Results of storage stability testing
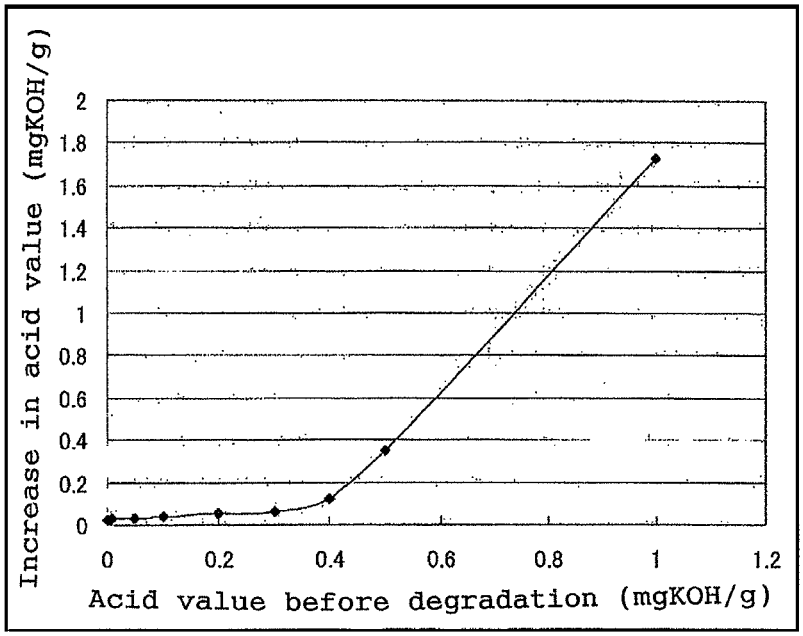

LUBRICATING OIL ADDITIVE COMPOSITION AND METHOD FOR IMPROVING STORAGE STABILITY OF LUBRICATING OIL ADDITIVE COMPOSITION

TECHNICAL FIELD

The present invention relates to sulfur-based lubricating oil additive compositions which have antioxidant properties and wear-resistant properties and are excellent in long-term storage stability.

BACKGROUND ART

Lubricating oils are used in various fields of technology, such as engine oils, driving system oils, processing oils, and grease. The basic effects thereof are to adjust friction and prevent wear. It is required to improve antioxidant properties of lubricating oils for achieving a long-term use thereof. In addition to these basic effects, lubricating oils exhibit various effects (such as hydrolysis stability and anticorrosive properties) and are applied to various uses. Lubricating oil additives exhibiting a plurality of effects resulting from one kind of additive have been known. For example, zinc dithiophosphoric acid has been known in the art as an additive exhibiting both antioxidant properties and wear-resistant properties. Additives as above exhibiting a plurality of effects are advantageous because amounts of other additives can be reduced, there is no need to add other additives, the cost of lubricant oil can be reduced, and problems resulting from many kinds of additives present therein (for example, a problem that one additive counteracts the effect of the other additive and the like) can be solved.

Thiodicarboxylic acid esters such as thiodipropionic acid esters have been known as sulfur-based antioxidants (for example, see Patent publications 1 and 2). It has been known that the additives have wear-resistant properties as well as antioxidant properties (for example, see Patent publication 3). Thiodicarboxylic acid esters exhibit two properties, i.e., antioxidant properties and wear-resistant properties, but they have the drawbacks of poor storage stability and an increase in acid value of products during a long-term storage. In general, the increase in acid value of an additive is not preferable because properties of the additive are inhibited and performance of a lubricating oil composition comprising the additive is inhibited. In particular, as the acid value of thiodicarboxylic acid esters is gradually increased over time, the acid value is different, depending on the timing for use. Therefore, in general, thiodicarboxylic acid esters have not been used as lubricating oil additives because it is difficult to obtain lubricating oil compositions comprising the same and having stable performance.

PRIOR ART REFERENCES

Patent Publications

Patent publication 1: Japanese Patent Laid-open No. 7-062368

Patent publication 2: Japanese Patent Laid-open No. 2008-095076

Patent publication 3: Japanese Patent Laid-open No. 2009-519930

SUMMARY OF INVENTION

Problems to be Solved by the Invention

Thiodicarboxylic acid esters are additives having a plurality of performance characteristics and thus are extremely attractive as additives. Therefore, the problem to be solved by the present invention is to provide thiodicarboxylic acid esters having high long-term storage stability without inhibiting antioxidant properties and wear-resistant properties of the thiodicarboxylic acid esters.

Mean for Solving the Problems

Here, the inventors of this application after intense research, imparted a new function of reducing friction to thiodicarboxylic acid ester-based lubricating oil additives, and discovered compositions comprising the additive and having excellent in storage stability to complete the present invention. Namely, the present invention relates to a lubricating oil additive composition characterized by containing a compound (A) represented by general formula (1) below and a compound (B) represented by general formula (2) below and having an acid value of 0.01 to 0.4 mgKOH/g.

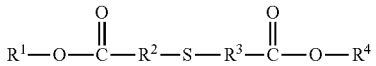

(1)

(in the formula, $R^1$ and $R^4$ each independently represent a hydrocarbon group having 6 to 18 carbon atoms and $R^2$ and $R^3$ each independently represent an alkylene group having 1 to 4 carbon atoms)

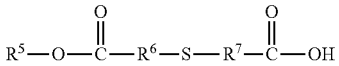

(2)

(in the formula, $R^5$ represents a hydrocarbon group having 6 to 18 carbon atoms and $R^6$ and $R^7$ each independently represent an alkylene group having 1 to 4 carbon atoms).

Effect of the Present Invention

The effect of the present invention is to provide thiodicarboxylic acid esters having high long-term storage stability without inhibiting the antioxidant properties and wear-resistant properties of the thiodicarboxylic acid esters.

BRIEF DESCRIPTION OF DRAWINGS

FIG. 1 shows the results of wear testing in the examples.

FIG. 2 shows the results of storage stability testing in the examples.

DETAILED DESCRIPTION OF THE PREFERRED EMBODIMENTS

The lubricating oil additive composition of the present invention contains a compound (A) represented by general formula (1) below and a compound (B) represented by general formula (2) below.

(1)

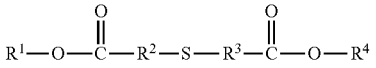

(in the formula, $R^1$ and $R^4$ each independently represent a hydrocarbon group having 6 to 18 carbon atoms and $R^2$ and $R^3$ each independently represent an alkylene group having 1 to 4 carbon atoms)

(2)

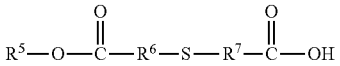

(in the formula, $R^5$ represents a hydrocarbon group having 6 to 18 carbon atoms and $R^6$ and $R^7$ each independently represent an alkylene group having 1 to 4 carbon atoms).

$R^1$ and $R^4$ of Compound (A) each independently represent a hydrocarbon group having 6 to 18 carbon atoms. Examples of the hydrocarbon group include alkyl groups such as hexyl group, isohexyl group, secondary hexyl group, heptyl group, isoheptyl group, secondary heptyl group, octyl group, isooctyl group, secondary octyl group, nonyl group, isononyl group, secondary nonyl group, decyl group, isodecyl group, secondary decyl group, undecyl group, isoundecyl group, secondary undecyl group, dodecyl group, isododecyl group, secondary dodecyl group, tridecyl group, isotridecyl group, secondary tridecyl group, tetradecyl group, isotetradecyl group, secondary tetradecyl group, hexadecyl group, isohexadecyl group, secondary hexadecyl group, and stearyl group; alkenyl groups such as hexenyl group, heptenyl group, octenyl group, nonenyl group, decenyl group, undecenyl group, dodecenyl group, tetradecenyl group, hexadecenyl group, and octadecenyl group; and aryl groups such as phenyl group, tolyl group, xylyl group, cumenyl group, mesityl group, benzyl group, phenethyl group, styryl group, cinnamyl group, benzhydryl group, trityl group, ethylphenyl group, propylphenyl group, butylphenyl group, pentylphenyl group, hexylphenyl group, heptylphenyl group, octylphenyl group, nonylphenyl group, decylphenyl group, undecylphenyl group, dodecylphenyl group, styrenated phenyl group, p-cumylphenyl group, phenylphenyl group, benzylphenyl group, α-naphthyl group, and β-naphthyl group. Among them, alkyl groups are preferable, those having 8 to 16 carbon atoms are more preferable, and branched alkyl groups having 8 to 16 carbon atoms are even more preferable, due to their friction reducing action and excellent solubility in lubricating oils. $R^1$ and $R^4$ may be the same or different, but they are preferably the same because the production thereof is simple.

$R^2$ and $R^3$ of Compound (A) each independently represent an alkylene group having 1 to 4 carbon atoms. Examples of the alkylene group include methylene group, ethylene group, propylene group, isopropylene group, butylene group, tertiary butylene group, and the like. Among them, $R^2$ and $R^3$ each are preferably ethylene group because the material is easily available.

$R^5$ of Compound (B) represents a hydrocarbon group having 6 to 18 carbon atoms. Examples of the hydrocarbon group include the hydrocarbon groups exemplified as $R^1$ and $R^4$ of Compound (A). Among them, alkyl groups are preferable, those having 8 to 16 carbon atoms are more preferable, and branched alkyl groups having 8 to 16 carbon atoms are even more preferable, due to their friction reducing action and excellent solubility in lubricating oils. $R^1$ and $R^4$ may be the same or different, but they are preferably the same because the production thereof is simple.

$R^6$ and $R^7$ of Compound (B) each independently represent an alkylene group having 1 to 4 carbon atoms. Examples of the alkylene group include methylene group, ethylene group, propylene group, isopropylene group, butylene group, tertiary butylene group, and the like. Among them, $R^7$ and $R^8$ each are preferably an ethylene group because the material is easily available.

Further, the lubricating oil additive composition of the present invention should have an acid value of 0.01 to 0.4 mgKOH/g, preferably 0.01 to 0.3 mgKOH/g, more preferably 0.02 to 0.15 mgKOH/g, even more preferably 0.02 to 0.1 mgKOH/g. If the acid value is lower than 0.01 mgKOH/g, excellent wear-resistant properties cannot be obtained. If the acid value is higher than 0.4 mgKOH/g, the long-term storage stability of the lubricating oil additive composition becomes poor. If the acid value is lower, long-term storage stability becomes more excellent, but at the same time, wear-resistant properties become poor. Therefore, both the properties cannot be satisfied unless the acid value is within the range of 0.01 to 0.4 mgKOH/g. The acid value is different, dependent on the kind of carboxylic acid contained in Compound (B) and thus the specific acid value can be determined, depending on the amount of Compound (B) blended. However, the acid value is also different, dependent on the structure of Compound (B) (difference in molecular weight).

In order to obtain the lubricating oil additive composition of the present invention, Compound (A) and Compound (B) are separately synthesized and are blended such that the resulting composition has an acid value of 0.01 to 0.4 mgKOH/g. However, Compound (B) should be formed preferably at the same time when Compound (A) is synthesized to obtain the lubricating oil additive composition of the present invention by one reaction. Both the compounds can be produced as follows, for example. A thiodicarboxylic acid such as thiodipropionic acid is esterified with an alcohol having 6 to 18 carbon atoms. At that time, if the total amount of the alcohol, i.e., two moles based on one mole of the thiodicarboxylic acid is reacted, Compound (A) is completely formed. However, if the reaction is stopped or the ratio of the reactants is adjusted such that the esterification reaction will not be completed, a monoester Compound (B) can be formed. The lubricating oil additive composition of the present invention can be obtained by controlling the amount of the monoester formed. If the acid value of the obtained composition is not within the range of 0.01 to 0.4 mgKOH/g, the acid value can be lowered by the method for adjusting the acid value comprising separately adding Compound (A) or Compound (B) to the obtained composition. If the acid value is high, it can be lowered using an acid adsorbent.

The lubricating oil of the present invention contains 0.1 to 5 wt % of the lubricating oil additive composition of the present invention. If it accounts for less than 0.1 wt %, an effect as an additive cannot be sufficiently obtained, while if it accounts for more than 5 wt %, the level of effect expected to be obtained according to the amount of the composition blended cannot be obtained. Mineral oils, plant and animal oils, or synthetic oils can be used as base oils of the lubricating oil. However, a mineral oil or synthetic oil is preferably used because the effect of the lubricating oil composition of the present invention can be easily obtained.

Mineral oils are separated from natural crude oils and are produced by distillation, purification, and the like thereof. The main components of mineral oils are hydrocarbons (mostly, paraffin), but they also comprise naphthenes, aromatic components, and the like. In general, mineral oils, called paraffin-based mineral oils and naphthene-based mineral oils as well, are mineral oils obtained by purification such as hydrorefining, solvent deasphalting, solvent extraction, solvent dewaxing, hydrogenation dewaxing, catalytic dewaxing, hydrogenolysis, alkaline distillation, washing with sulfuric acid, and clay treatment. Any of them can be used in the present invention. Synthetic oils are lubricating oils chemically synthesized. Examples thereof include poly-α-olefins, polyisobutylene(polybutene), diesters, polyol esters, phosphoric acid esters, silicic acid esters, polyalkylene glycols, polyphenyl esters, alkyl benzenes, and the like. Among these synthetic oils, poly-α-olefins, polyisobutylene(polybutene), diesters, polyol esters, and polyalkylene glycols are preferably used.

The lubricating oil additive composition of the present invention may contain other components so long as they do not inhibit the effects of the present invention. Examples of other lubricating oil additives include oily agents, friction reducing agents, extreme-pressure agents, antioxidants, cleansing agents, dispersants, viscosity index improvers, antifoaming agents, antirusting agents, pour-point depressants, emulsifiers, surfactants, anticorrosives, metal deactivators, and the like.

The lubricating oil additive composition of the present invention can be used in lubricating oils of various technical fields. Specific fields of technology in which the lubricating oil additive composition of the present invention can be used include, for example, gear oils, turbine oils, sliding surface oils, engine oils, operating oils, metalworking fluid, compression member oils, hydraulic fluid, grease base oils, thermal medium oils, machine tool oils, gear wheel oils, bearing oils, and the like. It is preferably used in gear oils, turbine oils, engine oils, operating oils, and metalworking fluid.

EXAMPLES

The present invention will be explained in more detail with reference to the examples below.

<Synthesis of Test Samples>

(Test Sample 1-A)

178 g (1 mole) of thiodipropionic acid and 430 g (2.15 moles) of branched tridecyl alcohol (trade name: TRIDECANOL, distributed by Kyowa Hakko Chemical Co., Ltd.) were put into a 1000 ml four-neck flask equipped with a thermometer, a nitrogen inlet, a suction tube for pressure reduction, and a stirrer and then 0.6 g of sulfuric acid as a catalyst was added to the system. After replacing the air in the system with nitrogen, the pressure in the system was reduced to $1.4\times10^4$ Pa while stirring and the temperature in the system was raised to 150° C. to conduct a reaction under reduced pressure for five hours. The pressure in the system was further reduced to $3.0\times10^3$ Pa and the reaction had been conducted at 150° C. for three hours until the esterification reaction was completed. 300 g of 2 wt % aqueous sodium carbonate solution was added to the system, the mixture was agitated at 30° C. for 30 minutes, and then was made to stand in order to separate the oil phase from the water phase and remove the catalyst. Washing with the alkaline solution in the above manner was repeated three times, all the acid components present in the system were removed, and then water washing with 300 g of pure water was carried out in the same manner. After water washing, the temperature in the system was raised to 100° C., dehydration at $3.0\times10^3$ Pa was carried out for one hour to obtain Test sample 1-A. The acid value of Test sample 1-A was 0.

(Test Sample 1-B)

178 g (1 mole) of thiodipropionic acid and 200 g (1 mole) of branched tridecyl alcohol (trade name: TRIDECANOL, distributed by Kyowa Hakko Chemical Co., Ltd.) were put into a 1000 ml four-neck flask equipped with a thermometer, a nitrogen inlet, a suction tube for pressure reduction, and a stirrer and then 0.5 g of sulfuric acid as a catalyst was added to the system. After replacing the air in the system with nitrogen, the pressure in the system was reduced to $1.4\times10^4$ Pa while stirring and the temperature in the system was raised to 150° C. to conduct a reaction under reduced pressure for five hours. The pressure in the system was further reduced to $3.0\times10^3$ Pa and the reaction was conducted at 150° C. for three hours until the esterification reaction was completed. 300 g of 2 wt % aqueous sodium carbonate solution was added to the system, the mixture was agitated at 30° C. for 30 minutes, and then was made to stand in order to separate the oil phase from the water phase and remove the catalyst. Further, 300 g of pure water was added and water washing in the same manner was carried out. After water washing, dehydration at 100° C. and at $3.0\times10^3$ Pa was carried out for one hour to obtain Test sample 1-B. The acid value of Test sample 1-B was 156 mgKOH/g.

(Other Samples)

Test samples 2-A, 2-B, 3-A, and 3-B were synthesized by using a different kind of alcohol in the same production process as for Test samples 1-A and 1-B above. The structure of each test sample is shown below. The branched octadecyl alcohol used was FINE OXOCOL 180 (trade name) (distributor: Nissan Chemical Industries, Ltd.)

Test sample 1-A: thiodipropionic acid di-branched tridecyl ester (in general formula (1), $R^1$ and $R^4$ each represent a branched tridecyl group and $R^2$ and $R^3$ each represent ethylene group) having an acid value of 0

Test sample 1-B: thiodipropionic acid mono-branched tridecyl ester (in general formula (2), $R^5$ represents a branched tridecyl group and $R^6$ and $R^7$ each represent ethylene group) having an acid value of 156 mgKOH/g Test sample 2-A: thiodipropionic acid di-branched octadecyl ester (in general formula (1), $R^1$ and $R^4$ each represent a branched octadecyl group and $R^2$ and $R^3$ each represent ethylene group) having an acid value of 0

Test sample 2-B: thiodipropionic acid mono-branched octadecyl ester (in general formula (2), $R^5$ represents a branched octadecyl group and $R^6$ and $R^7$ each represent ethylene group) having an acid value of 124 mgKOH/g Test sample 3-A: thiodipropionic acid dibenzyl ester (in general formula (1), $R^1$ and $R^4$ each represent benzyl group and $R^2$ and $R^3$ each represent ethylene group) having an acid value of 0

Test sample 3-B: thiodipropionic acid monobenzyl ester (in general formula (2), $R^5$ represents benzyl group and $R^6$ and $R^7$ each represent ethylene group) having an acid value of 193 mgKOH/g (Test Sample 4)

178 g (1 mole) of thiodipropionic acid and 400 g (2 moles) of branched tridecyl alcohol (trade name: TRIDECANOL, distributed by Kyowa Hakko Chemical Co., Ltd.) were put into a 1000 ml four-neck flask equipped with a thermometer, a nitrogen inlet, a suction tube for pressure reduction, and a stirrer and then 0.6 g of sulfuric acid as a catalyst was added to the system. After replacing the air in the system with nitrogen, the pressure in the system was reduced to $1.4\times10^4$ Pa while stirring and the temperature in the system was raised to 150° C. to conduct a reaction under reduced pressure for five hours. 300 g of 2 wt % aqueous sodium carbonate solution was added to the system, the mixture was agitated at 30°

C. for 30 minutes, and then was made to stand in order to separate the oil phase from the water phase and remove the catalyst. Dehydration at 100° C. and at $3.0\times10^3$ Pa was carried out for one hour to obtain Test sample 4. The acid value of Test sample 4 was 0.1 mgKOH/g.

<Preparation of Test Oil>

Samples were prepared by adjusting the acid values of the test samples above, and then were dissolved in a base oil to obtain sample oils. The base oil used was a mineral oil-based lubricating base oil having the following properties, i.e., kinetic viscosity of 4.24 $mm^2$/sec (at 100° C.) and 19.65 $mm^2$/sec (at 40° C.) and a viscosity index of 126.

Test oil 1: Test sample 1-A (having an acid value of 0) was dissolved in the base oil such that it accounted for 0.5 wt %.

Test oil 2: Test sample 1-A and Test sample 1-B were blended to prepare a sample having an acid value of 0.005 mgKOH/g. The sample was dissolved in the base oil such that it accounted for 0.5 wt %.

Test oil 3: Test sample 1-A and Test sample 1-B were blended to prepare a sample having an acid value of 0.01 mgKOH/g. The sample was dissolved in the base oil such that it accounted for 0.5 wt %.

Test oil 4: Test sample 1-A and Test sample 1-B were blended to prepare a sample having an acid value of 0.05 mgKOH/g. The sample was dissolved in the base oil such that it accounted for 0.5 wt %.

Test oil 5: Test sample 1-A and Test sample 1-B were blended to prepare a sample having an acid value of 0.1 mgKOH/g. The sample was dissolved in the base oil such that it accounted for 0.5 wt %.

Test oil 6: Test sample 1-A and Test sample 1-B were blended to prepare a sample having an acid value of 0.2 mgKOH/g. The sample was dissolved in the base oil such that it accounted for 0.5 wt %.

Test oil 7: Test sample 1-A and Test sample 1-B were blended to prepare a sample having an acid value of 0.3 mgKOH/g. The sample was dissolved in the base oil such that it accounted for 0.5 wt %.

Test oil 8: Test sample 1-A and Test sample 1-B were blended to prepare a sample having an acid value of 0.4 mgKOH/g. The sample was, dissolved in the base oil such that it accounted for 0.5 wt %.

Test oil 9: Test sample 1-A and Test sample 1-B were blended to prepare a sample having an acid value of 0.5 mgKOH/g. The sample was dissolved in the base oil such that it accounted for 0.5 wt %.

Test oil 10: Test sample 1-A and Test sample 1-B were blended to prepare a sample having an acid value of 1 mgKOH/g. The sample was dissolved in the base oil such that it accounted for 0.5 wt %.

Test oil 11: Test sample 2-A and Test sample 2-B were blended to prepare a sample having an acid value of 0.1 mgKOH/g. The sample was dissolved in the base oil such that it accounted for 0.5 wt %.

Test oil 12: Test sample 3-A and Test sample 3-B were blended to prepare a sample having an acid value of 0.1 mgKOH/g. The sample was dissolved in the base oil such that it accounted for 0.5 wt %.

Test oil 13: Test sample 4 (having an acid value of 0.1 mgKOH/g) was dissolved in the base oil such that it accounted for 0.5 wt %.

Test oils 1, 2, 9, 10, and 14 were comparative products.

<Wear Testing>

Friction property testing was carried out using a Bauden Leben type testing apparatus HHS2000 (Shinto Scientific Co., Ltd.). A SUJ2 ball for testing and a SUJ2 sheet for testing were placed at the predetermined positions of the Bauden Leben type testing apparatus and 50 μl of each test oil listed in Table 1 was poured between the two materials for testing. Then, the test was started under the conditions at a load with 1000 g and at a sliding rate of 20 mm/s to determine the wear track size (the diameter of wear track) of the SUJ2 ball for testing when the total sliding distance became 40 m. It showed that the smaller the wear track size was, the greater the level of wear-resistant properties the sample had. The results are shown in Table 1.

<Storage Stability Testing>

100 g of the test samples used in Test oils 1 to 13 (Test oil 2 to 12 were mixture products of test samples, Test oil 1 was Test sample 1-A, and Test oil 13 was Test sample 4) were put in 150 ml glass tubes each having a lid and the tubes were sealed. The tubes were placed in a constant temperature reservoir at 50° C. for one month and the acid values of the test samples after one month were determined. The results thereof are shown in Table 1. Test oils 1 to 13 in Table 1 mean the test samples used in the corresponding test oil.

<Oxidation Stability Testing>

The test was carried out in accordance with the method of JIS K-2514. More specifically, 50 g of a test oil, 5 g of water, and 3 m of a copper wire having a diameter of 1.6 mm as a catalyst that had been rolled to be compact were put into a pressure-resistant cylinder having a volume of 100 ml equipped with a pressure gauge. After the cylinder was sealed, oxygen was injected in the cylinder until the pressure therein became 620 kPa. The cylinder was rotated at a rotation rate of 100 r.p.m while being tilted at an angle of 30° in the constant temperature reservoir at 150° C. First, the pressure in the cylinder was raised as heated, but from the time when oxidation degradation started, oxygen was adsorbed and the pressure in the cylinder was lowered. The pressure was measured over time, and the period of time required for the pressure to be lowered to 175 kPa from the point when the pressure was the highest was determined. The period of time was considered as a period of time required for oxidation degradation. If the period of time of a test sample is longer than those of other test samples, it means that the test sample has excellent antioxidant properties. The results thereof are shown in Table 1.

TABLE 1

(test results)

| | Wear | Storage stability testing (mgKOH/g) | | Oxidation stability |
|---|---|---|---|---|
| | testing (mm) | Measured value | Increased value | testing (min) |
| Test oil 1 | 0.63 | 0.02 | 0.02 | 55 |
| Test oil 2 | 0.62 | 0.03 | 0.02 | 56 |
| Test oil 3 | 0.51 | 0.04 | 0.03 | 54 |
| Test oil 4 | 0.49 | 0.08 | 0.03 | 57 |
| Test oil 5 | 0.49 | 0.14 | 0.04 | 56 |
| Test oil 6 | 0.48 | 0.25 | 0.05 | 53 |
| Test oil 7 | 0.47 | 0.36 | 0.06 | 55 |
| Test oil 8 | 0.46 | 0.52 | 0.12 | 57 |
| Test oil 9 | 0.46 | 0.85 | 0.35 | 58 |
| Test oil 10 | 0.46 | 2.73 | 1.73 | 56 |
| Test oil 11 | 0.49 | 0.15 | 0.05 | 62 |
| Test oil 12 | 0.52 | 0.14 | 0.04 | 52 |
| Test oil 13 | 0.49 | 0.14 | 0.04 | 55 |
| Test oil 14 | 0.61 | 0 | 0 | 13 |

Test oil 14: only the base oil was evaluated.

Increased value = the acid value (measure value) of the test sample after the storage testing − the acid value of the test sample before the storage testing The results of the wear testing and storage stability testing are shown in graphs. FIG. 1 shows the results of wear testing and FIG. 2 shows the results of storage stability testing (rising values).

The results of wear testing indicate that the wear-resistant properties of Test oil 1 having an acid value of 0 and Test oil 2 having an acid value of 0.005 mgKOH/g were worse, compared with the base oil (Test oil 14) without additives, while test oils having an acid value of 0.01 or higher clearly exhibited improved wear-resistant properties. On the other hand, in the storage stability testing, the higher the acid value, the worse the storage stability becomes. The storage stability was significantly reduced in the test samples having an acid value before the storage stability testing of higher than 0.4 mgKOH/g. There was no difference in oxidation stability among all the test samples.

The invention claimed is:

1. A lubricating oil additive composition consisting of:

a compound (A) represented by formula (1), (1)

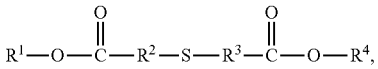

wherein $R^1$ and $R^4$ each independently represent a hydrocarbon group having 6 to 18 carbon atoms, and $R^2$ and $R^3$ each independently represent an alkylene group having 1 to 4 carbon atoms, and a compound (B) represented by formula (2), (2)

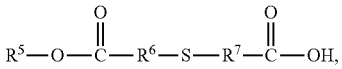

wherein $R^5$ represents a hydrocarbon group having 6 to 18 carbon atoms, and $R^6$ and $R^7$ each independently represent an alkylene group having 1 to 4 carbon atoms, and having an acid value of 0.01 to 0.4 mgKOH/g.

2. The lubricating oil additive composition according to claim 1, wherein each of $R^2$, $R^3$, $R^6$, and $R^7$ is an ethylene group and $R^1$, $R^4$, and $R^5$ are the same group.

3. The lubricating oil additive composition according to claim 1, wherein the acid value is from 0.01 to 0.3 mgKOH/g.

4. A method for improving the storage stability of a lubricating oil additive composition comprising:

adjusting an acid value of a lubricating additive composition consisting of:

a compound (A) represented by formula (1), (1)

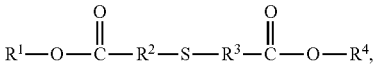

wherein $R^1$ and $R^4$ each independently represent a hydrocarbon group having 6 to 18 carbon atoms, and $R^2$ and $R^3$ each independently represent an alkylene group having 1 to 4 carbon atoms, and a compound (B) represented by formula (2), (2)

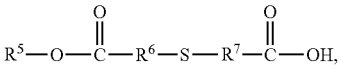

wherein $R^5$ represents a hydrocarbon group having 6 to 18 carbon atoms, and $R^6$ and $R^7$ each independently represent an alkylene group having 1 to 4 carbon atoms, to 0.01 to 0.4 mgKOH/g.

5. The lubricating oil additive composition according to claim 2, wherein the acid value is from 0.01 to 0.3 mgKOH/g.

* * * * *